US005240441A

United States Patent [19]

Laricchia et al.

[11] Patent Number: 5,240,441

[45] Date of Patent: Aug. 31, 1993

[54] ELECTRICAL WIRE CONNECTOR

[75] Inventors: Rocco V. Laricchia, Pickering; Randy T. Cole, Richmond Hill, both of Canada

[73] Assignee: The Whitaker Corporation, Wilmington, Del.

[21] Appl. No.: 940,595

[22] Filed: Sep. 4, 1992

[51] Int. Cl.[5] ..... H01R 4/50

[52] U.S. Cl. ..... 439/783; 439/863

[58] Field of Search ..... 439/499, 783, 786, 863

[56] References Cited

U.S. PATENT DOCUMENTS

| | | | |
|---|---|---|---|
| 1,801,277 | 4/1931 | Kelley | 339/247 |
| 2,106,724 | 2/1938 | Cope | 339/247 |
| 3,275,974 | 9/1966 | Mixon | 339/243 |
| 3,462,543 | 8/1969 | Wahl et al. | 439/783 |
| 4,330,906 | 5/1982 | Werner | 24/136 R |
| 4,415,222 | 11/1983 | Polidori | 339/270 R |
| 4,504,034 | 3/1985 | Werner | 248/63 |
| 4,600,264 | 7/1986 | Counsel | 339/247 |
| 5,006,081 | 4/1991 | Counsel et al. | 439/783 |

*Primary Examiner*—Paula A. Bradley

*Attorney, Agent, or Firm*—Bruce J. Wolstoncroft

[57] ABSTRACT

An electrical wire connector of the type having a wedge with converging side surfaces forcible into a C-shaped member between converging ears thereof, includes concave channel portions of the wedge side surface opposing arcuate inner surfaces of the ears to clamp a transmission line, stirrup, and strain clamp member therein under substantial clamping force to common and mechanically join them. The strain clamp cooperates with the electrical wire connector to prevent forces applied to the transmission line from being transmitted to the stirrup, thereby ensuring that a positive electrical connection is maintained between the transmission line and the stirrup.

10 Claims, 2 Drawing Sheets

ELECTRICAL WIRE CONNECTOR

FIELD OF THE INVENTION

The invention relates to the field of electrical connectors and more particularly to electrical connectors commoning and mechanically securing electrical wires.

BACKGROUND OF THE INVENTION

Electrical connectors of the type having a C-shaped body member having converging channels and a complementary wedge member have been known conventionally for many years and are disclosed for example in U.S. Pat. Nos. 1,801,777; 4,415,222; 4,600,264; and 5,006,081. Basically, two uninsulated conductors are electrically and mechanically connected by being pressed into and against interior curved surfaces or channels provided in a C-shaped body member by a wedge being driven longitudinally into the body member between the conductors. These known wedge connectors have been successfully used in the power utility industry for large diameter cable where the C-members are massive enough to exert a resilient compressive force against the cable trapped in the channels by the wedge. In U.S. Pat. No. 5,006,081 such a C-shaped wedge connector is disclosed for use with somewhat smaller diameter wire, and in one embodiment the wedge is stamped and formed from sheet metal such as brass while in another the wedge is solid.

Electrical stirrup connectors are also known in the industry. The stirrup connectors are used to connect tap wires from the energized electrical transmission line of high voltage to a transformer or other piece of equipment, form a branch line, or provide other suitable connections. These connectors obviate connecting directly to transmission lines and thereby preclude damaging them as a result of an arc which frequently occurs between the transmission lines and the connection thereto. U.S. Pat. No. 3,275,974 discloses such a connector. This stirrup connector has a C-shape and is configured to be easily installed on the transmission line.

Traditional bolted dead end termination members are also known in the industry. These devices are placed at the end of the transmission lines to secure the transmission lines to a utility pool or insulator. In order to be effective these members must be able to withstand significant forces without failure. The bolted dead end members known in the industry have numerous pieces and are difficult to install on the line.

It is therefore important to provide a dead end termination member which is reliable under load and is easy to install in the field. It would be beneficial it the dead end termination member also had adequate electrical characteristics to allow the member to act as an electrical connector (in applications where a stirrup or the like is required) as well as a mechanical strain clamp.

SUMMARY OF THE INVENTION

The invention is directed to a termination member which is readily applied to an existing energized transmission line. A strain clamp member is positioned in the termination member such that the forces applied to the transmission line will not cause the termination member to fail. The termination member can also have adequate electrical characteristics to ensure that a positive electrical connection will be effected and maintained as needed.

The termination member has a C-shaped body member and a wedge-shaped member. The C-shaped body member includes at least one ear which has an arcuate inner surface. A strain clamp cooperates with the termination member and has an insulator mounting section, a mating section, and an engagement section. A transmission line is positioned between the arcuate inner surface of the C-shaped body member and the mating section of the strain clamp, whereby when the wedge-shaped member is fully inserted into the C-shaped body member, the strain clamp will prevent the movement of the termination member and ensure that forces applied to the transmission line will be transmitted through the stain clamp member to an insulator.

DETAILED DESCRIPTION OF THE INVENTION

Figure 1:
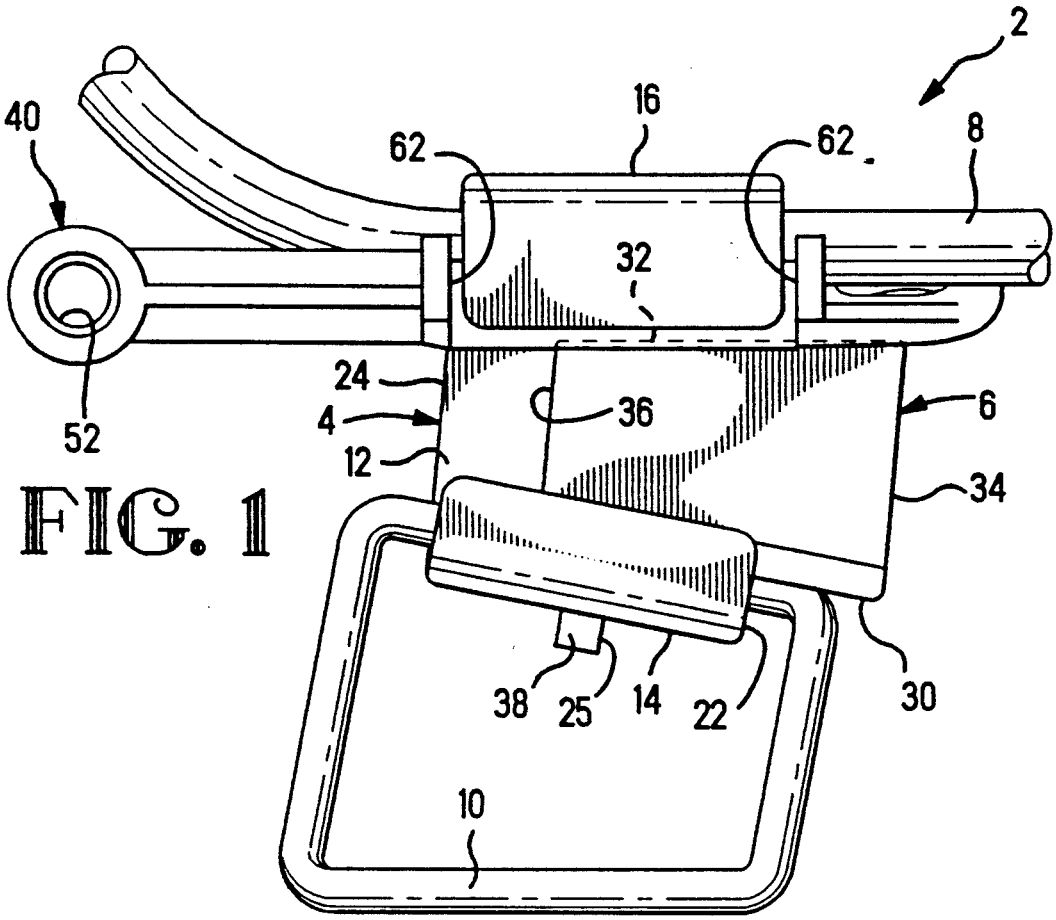
FIG. 1 is a front elevational view partially in section of an electrical connector of the present invention.

Referring to FIG. 1, termination member 2 has a C-shaped body member 4 and a wedge-shaped member 6. In the embodiment shown, the termination member provides the electrical connection between a transmission line 8 and a stirrup 10. It is important to note that the termination member may act merely as a mechanical clamping device in which the termination member is a strain clamp (i.e. the stirrup 10 would not be positioned in the termination member). This type of connector is commonly referred to as a dead end connector.

C-shaped body member 4 includes a bight section 12 extending to opposed ears 14, 16 having arcuate inner surface 18, 20 defining outer peripheries of wire channels, and decreasing linearly in width from forward end 22 to rearward end 24. A respective ear 14 has an opening 25 which extends therethrough.

Wedge-shaped member 6 has concave channel sections 26, 28 formed along side surfaces 30, 32 extending from forward end 34 to rearward end 36, and decreasing linearly in width from forward end 34 to rearward end 36.

Stirrup 10 is preferably bent into a generally rectangular configuration. An end 38 of the stirrup is bent such that the end 38 is disposed within opening 25. The positioning of the end in the opening ensures that a portion of the stirrup 10 is maintained in cooperation with ear 14 of member 4.

C-shaped member 4 and wedge-shaped member 6 are preferably made from aluminum, and the stirrup is preferably made from copper. It is worth noting that other materials can be used for both members 4, 6, particularly if the termination member 2 is to be used as a purely mechanical strain clamp, thereby not requiring the termination member to exhibit electrical characteristics.

Figure 4:
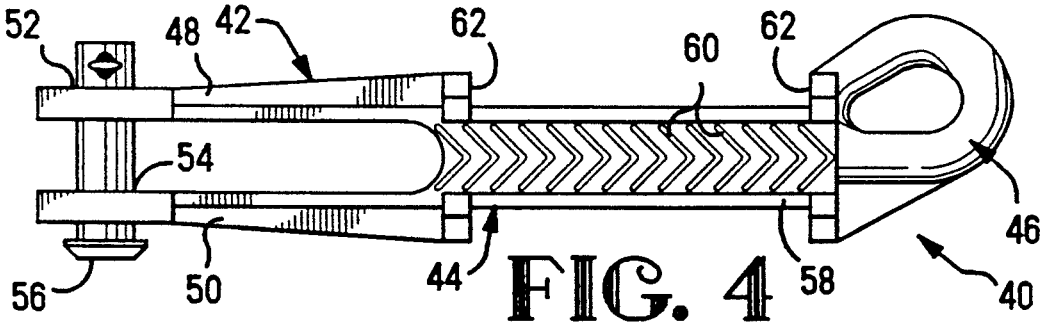
FIG. 4 is a side view of a strain clamp member for use in the electrical connector.

A strain clamp member 40 also cooperate with the members 4, 6. The strain clamp member 40, as shown in FIG. 4, has a pole or insulator mounting section 42, a termination member mating section 44 and an engagement section 46. The pole mounting section 42 has two essentially parallel legs 48, 50 which extend from the connector mating section 44. At the free ends of the legs 48, 50, openings 52, 54 are provided. The openings are dimensioned to receive a clevis pin 56 therein.

Figure 3:
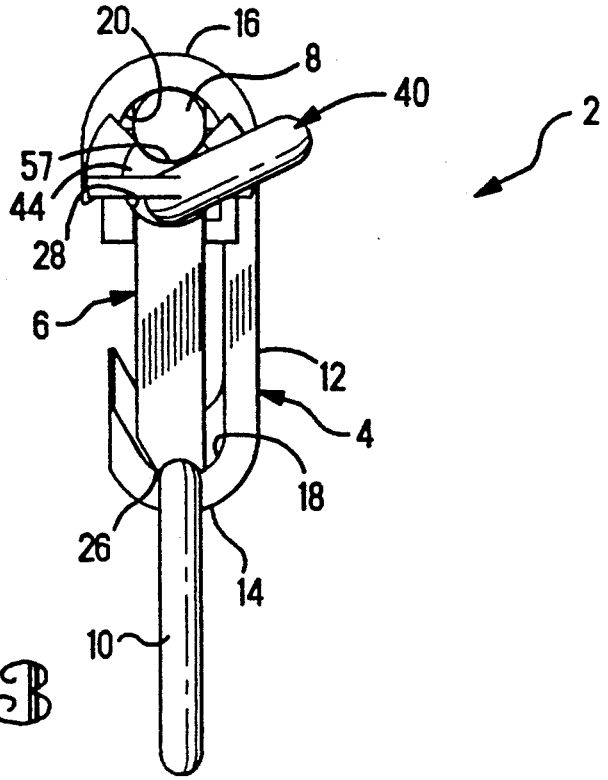
FIG. 3 is a side elevational view of the fully assembled connector of FIG. 1.
Figure 5:
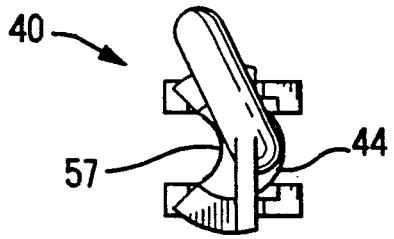
FIG. 5 is an end view of the strain clamp member shown in FIG. 4.

The termination member mating section 44 extends from the mounting section 42 to the engagement section 46. As is illustrated in FIGS. 3 and 5, mating section 44 has a cylindrical configuration. An arcuate recess 57 is provided in the mating section and extends the length thereof. The wall 58 of the arcuate recess 57 has V-shaped ribs 60 provided thereon. At each end of the mating section 44 are shoulders 62.

The engagement section 46 is provided at an end of the mating section 44. The engagement section 46 is configured to allow for ease of handling.

In assembly, the strain clamp member 40 is attached to a utility pool or insulator (not shown) by means of the clevis pin 56. A ratchet tool (not shown) is attached to the engagement end and to the transmission line. The ratchet tool is then operated, in a manner well known in the industry, to provide slack in the transmission line.

In the embodiment shown, the stirrup 10 is then positioned on surface 18 of ear 14. In this position end 38 extends through opening 25 to maintain the stirrup in position relative to C-shaped member 4. The C-shaped member 4, with the stirrup position therein, is then moved into cooperation with the transmission line 8. The ear 16 is inserted over the transmission line, such that the transmission line is positioned in arcuate inner surface 20. The strain clamp member 40 is then moved into cooperation with the transmission line 8. As is best shown in FIG. 3, the arcuate recess 57 of the strain clamp member 40 is positioned to receive the transmission line 8 therein. As is shown in FIG. 1, the C-shaped body member 4 is positioned between the shoulders 62 of the strain clamp member 40.

The particular order in which the transmission line, stirrup, and strain clamp member are positioned in the termination member can vary according to the preference of the installer.

Figure 2:
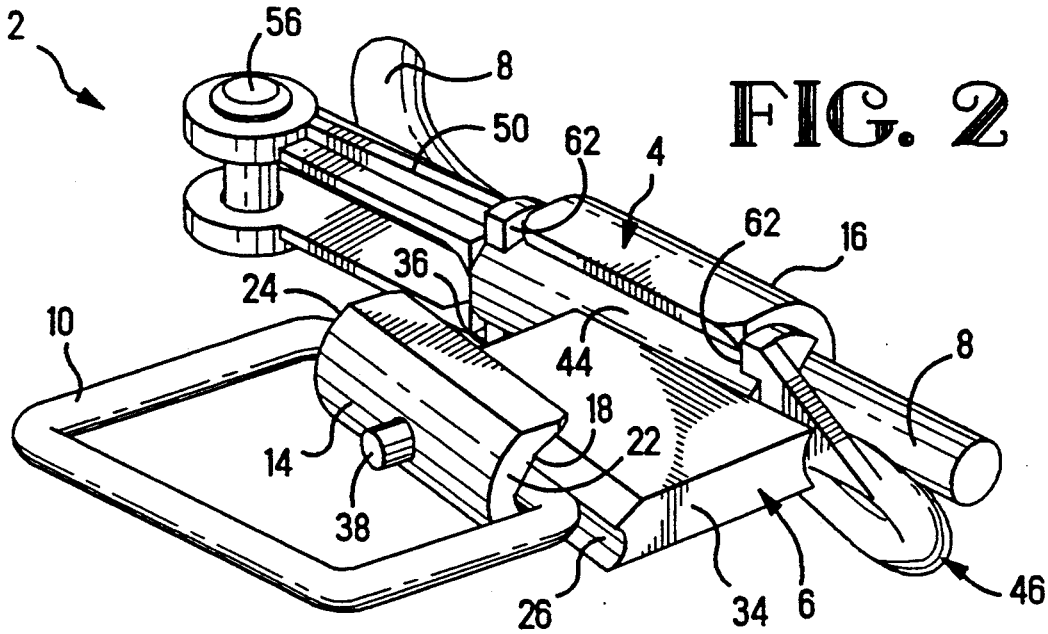
FIG. 2 is a perspective view of the connector in a partially assembled position.

With the stirrup 10, transmission line 8, and strain clamp member 40 properly position, the wedge-shaped member 6 is placed in the C-shaped body member 4. Respective concave channel section 26, 28 engage the stirrup 10 and the mating section 44 of the strain clamp member 40. The wedge-shaped member is tapped, as with a hammer or other tool, to partially assemble the termination member, as shown in FIG. 2.

The partially assembled connection is completed by an explosively-operated tool of the type described in U.S. Pat. No. 3,292,363, which is hereby incorporated by reference. In using the explosively-operated tool to effect the connection, wedge-shaped member 6 moves at such a rapid rate of speed along stirrup 10 and strain clamp member 40 that they are cleaned of oxides and other matter as a result of pressure created between the members 4 and 6. Due to the pressure generated during the connection, the ribs 60 provided on the arcuate recess 57 of the strain clamp member 40 are forced into engagement with the transmission line 8, thereby penetrating the oxides and other matter provided on the transmission line 8. As each interconnection has a means to penetrate oxides and the like, the need to clean the areas prior to termination is eliminated.

With the termination member fully assembled, the strain clamp member 40 prevents the forces applied to the transmission line from being transmitted to the stirrup. As forces are applied to the transmission line, the transmission line will cause the termination member to be moved in a direction parallel to the longitudinal axis of the line. However, this movement will be restricted by the strain clamp member. The C-shaped member will engage a respective shoulder of the strain clamp member to prevent significant movement of the C-shaped member in either direction. As the strain clamp member is rigid and attached to the utility pole or the insulator, the forces which are applied to the line will be transmitted through the strain clamp member to the pole. As the movement of the termination member is essentially eliminated, the weak stirrup will not be deformed.

As is evident from the above description, the termination member shown in the drawings provides both an electrical and mechanical connection between the transmission line and the stirrup. The strain clamp member, in the embodiment disclosed, is utilized as a mechanical member. It is envisioned that the strain clamp member could have electrical as well as mechanical characteristics.

The electrical connector described herein is readily applied to an existing energized transmission line. A reliable electrical connection is assured irrespective of vibration, temperature change or change in the transmission line tension. As the strain clamp member is attached to the utility pole, the change in line tension will not cause failure of the connection, as the forces associated with the change in line tension will be absorbed by the stain clamp member rather than transmitted to the weaker stirrup.

In the embodiment described above, the stirrup is positioned within the termination member. However, it is conceived that a jumper stud or other such device could be used in place of the stirrup. In these applications the termination member is used a both an electrical and mechanical device.

In other instances, the termination member would be used solely as a mechanical clamping device. In these applications no stirrup or jumper stud would cooperate with the termination member. Consequently, the termination member would be similar to that shown in FIG. 1, with the exception that no stirrup would be provided.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

We claim:

1. A termination member having a C-shaped body member and a wedge-shaped member, the C-shaped body member includes at least one ear which has an arcuate inner surface;

a strain clamp having an insulator mounting section, a mating section, and an engagement section;

a transmission line positioned between the arcuate inner surface of the C-shaped body member and the mating section of the strain clamp;

whereby when the wedge-shaped member is fully inserted into the C-shaped body member, the strain clamp will prevent the movement of the termination member and ensure that forces applied to the transmission line will be transmitted through the stain clamp member to an insulator.

2. A termination member as recited in claim 1 wherein the wedge-shaped member has a concave channel section formed along a respective side surface, the channel section and the arcuate inner surface form an area to receive the strain relief member and transmission line therein.

3. A termination member as recited in claim 1 wherein the C-shaped body member and the wedge-shaped member decrease linearly in width from respective forward ends to rearward ends.

4. A termination member as recited in claim 1 wherein the termination member is made from material having, the required mechanical strength.

5. A termination member as recited in claim 1 wherein the C-shaped member has a second ear which has a second arcuate inner surface and the wedge-shaped member has a second concave channel section which cooperate to maintain a second electrical member in the termination member, the termination member is made from material having the required electrical characteristics to ensure that a positive electrical connection is effected between the transmission line and the second electrical member.

6. A termination member as recited in claim 1 wherein the mounting section of the strain clamp has two essentially parallel legs which extend from the mating section.

7. A termination member as recited in claim 6 wherein openings are provided at free ends of the legs, the openings are dimensioned to receive a clevis pin therein.

8. A termination member as recited in claim 1 wherein the mating section of the strain clamp extends from the mounting section to the engagement section, the mating section having a generally cylindrical configuration.

9. A termination member as recited in claim 8 wherein an arcuate recess extends across the entire length of the mating section, the wall of the arcuate recess that V-shaped ribs provide thereon.

10. A termination member as recited in claim 8 wherein shoulders are provided at each end of the mating section, the shoulders are positioned to cooperate with the C-shaped body member to prevent the movement of the C-shaped body member relative to the strain clamp.

* * * * *

UNITED STATES PATENT AND TRADEMARK OFFICE

CERTIFICATE OF CORRECTION

PATENT NO. : 5,240,441

DATED : August 31, 1993

INVENTOR(S) : Rocco V. Laricchia and Randy T. Cole

It is certified that error appears in the above-identified patent and that said Letters Patent is hereby corrected as shown below:

Claim 4, line 3, column 5 , delete ",".

Claim 9, line 4, column 6 , "that" should be --has--.

Claim 9, line 4, column 6 , "provide" should be --provided--.

Signed and Sealed this

Fifth Day of April, 1994

Bruce Lehman

BRUCE LEHMAN

*Commissioner of Patents and Trademarks*

*Attest:*

*Attesting Officer*